US005935002A

United States Patent [19]

Falciglia

[11] Patent Number: 5,935,002

[45] **Date of Patent: *Aug. 10, 1999**

[54] COMPUTER-BASED SYSTEM AND METHOD FOR PLAYING A BINGO-LIKE GAME

[75] Inventor: Sal Falciglia, Ridgewood, N.J.

[73] Assignee: Sal Falciglia, SR. Falciglia Enterprises, Ridgewood, N.J.

[ * ] Notice: This patent is subject to a terminal disclaimer.

[21] Appl. No.: 08/848,505

[22] Filed: Apr. 28, 1997

Related U.S. Application Data

[63] Continuation-in-part of application No. 08/614,322, Mar. 12, 1996, Pat. No. 5,647,798, which is a continuation of application No. 08/402,085, Mar. 10, 1995, abandoned.

[51] Int. Cl.[6] ..... A63F 3/06; G07F 17/34

[52] U.S. Cl. ..... 463/19; 273/143 R; 463/20; 463/42

[58] Field of Search ..... 273/143 R, 269; 463/19, 42, 20

[56] References Cited

U.S. PATENT DOCUMENTS

| | | | |
|---|---|---|---|
| 4,743,024 | 5/1988 | Helm et al. | 273/143 R |
| 4,953,869 | 9/1990 | Muhammad | 273/236 |
| 5,351,970 | 10/1994 | Fioretti | 463/19 |
| 5,393,057 | 2/1995 | Marnell, II | 463/13 |
| 5,411,258 | 5/1995 | Wilson et al. | 463/28 |
| 5,695,400 | 12/1997 | Fennell, Jr. et al. | 463/42 |

FOREIGN PATENT DOCUMENTS

| | | | |
|---|---|---|---|
| 0 464 935 | 3/1992 | European Pat. Off. | 273/269 |
| 2 137 392 | 6/1984 | United Kingdom | 273/143 R |

*Primary Examiner*—Benjamin H. Layno
*Attorney, Agent, or Firm*—Dilworth & Barrese

[57] ABSTRACT

A device for playing a bingo-style game including an input device for receiving user inputs; a display for displaying a graphic user interface (GUI); and a processor. The GUI includes a five column by five row random number display matrix; five display regions; and a plurality of user-actuatable icons. The processor includes a first random number generator for generating five sets of random numbers for display by the five column by five row random number display matrix, in which the five sets of random numbers are grouped in predetermined ranges. The processor also includes a second random number generator which responds to the user inputs corresponding to actuation of the actuation icon by the user for generating a sixth set of random numbers for display by the five display regions. The processor compares the sixth set of random numbers displayed in the five display regions with the numbers in the columns of the display matrix, and allows the processor to automatically cover the matching number in the display matrix. The processor determines whether the display matrix has five numbers covered in a row, in a column, or in a diagonal, and generates a bingo indication signal for indicating a bingo condition.

8 Claims, 14 Drawing Sheets

| | | | | |
|---|---|---|---|---|
| 5 | 17 | 37 | 60 | 72 |
| 15 | 23 | 43 | 56 | 66 |
| 9 | 16 | 31 | 51 | 62 |
| 1 | 25 | 36 | 58 | 74 |
| 3 | 29 | 40 | 49 | 69 |

*FIG. 2A*

| | | | | |
|---|---|---|---|---|
| 5 | 17 | 37 | 60 | 72 |
| 15 | 23 | 43 | 56 | 66 |
| 9 | 16 | 31 | 51 | 62 |
| 1 | 25 | 36 | 58 | 74 |
| 3 | 29 | 40 | 49 | 69 |

*FIG. 2B*

| | | | | |
|---|---|---|---|---|
| 5 | 17 | 37 | 60 | 72 |
| 15 | 23 | 43 | 56 | 66 |
| 9 | 16 | 31 | 51 | 62 |
| 1 | 25 | 36 | 58 | 74 |
| 3 | 29 | 40 | 49 | 69 |

*FIG. 2C*

| | | | | |
|---|---|---|---|---|
| 5 | 17 | 37 | 60 | 72 |
| 15 | 23 | 43 | 56 | 66 |
| 9 | 16 | 31 | 51 | 62 |
| 1 | 25 | 36 | 58 | 74 |
| 3 | 29 | 40 | 49 | 69 |

*FIG. 2D*

| | | | | |
|---|---|---|---|---|
| 5 | 17 | 37 | 60 | 72 |
| 15 | 23 | 43 | 56 | 66 |
| 9 | 16 | 31 | 51 | 62 |
| 1 | 25 | 36 | 58 | 74 |
| 3 | 29 | 40 | 49 | 69 |

*FIG. 3A*

| | | | | |
|---|---|---|---|---|
| 5 | 17 | 37 | 60 | 72 |
| 15 | 23 | 43 | 56 | 66 |
| 9 | 16 | 31 | 51 | 62 |
| 1 | 25 | 36 | 58 | 74 |
| 3 | 29 | 40 | 49 | 69 |

*FIG. 3B*

| | | | | |
|---|---|---|---|---|
| 5 | 17 | 37 | 60 | 72 |
| 15 | 23 | 43 | 56 | 66 |
| 9 | 16 | 31 | 51 | 62 |
| 1 | 25 | 36 | 58 | 74 |
| 3 | 29 | 40 | 49 | 69 |

*FIG. 3C*

| | | | | |
|---|---|---|---|---|
| 5 | 17 | 37 | 60 | 72 |
| 15 | 23 | 43 | 56 | 66 |
| 9 | 16 | 31 | 51 | 62 |
| 1 | 25 | 36 | 58 | 74 |
| 3 | 29 | 40 | 49 | 69 |

*FIG. 3D*

COMPUTER-BASED SYSTEM AND METHOD FOR PLAYING A BINGO-LIKE GAME

RELATED APPLICATIONS

This is a continuation-in-part of application Ser. No. 08/614,322 filed on Mar. 12, 1996, now U.S. Pat. No. 5,647,798, which is a continuation of application Ser. No. 08/402,085, filed on Mar. 10, 1995, now abandoned.

BACKGROUND OF THE INVENTION

1. Field of the Invention

This disclosure relates to computer-based games and, more specifically, to a computer-based system and method for playing a bingo-like game.

2. Description of the Related Art

The game of bingo has for many years been a popular game to play by people of all ages. Bingo's popularity as a gambling game has grown to the point where gambling casinos have set up bingo games in recent years as an added attraction for their players. However, attempts to implement the game of bingo into a slot machine have been few and unsuccessful.

For example, U.S. Pat. No. 4,743,024 to Helm et al. discloses an amusement arcade machine for playing the game of bingo. As disclosed, the machine comprises a display panel having a fixed matrix of numbers corresponding to row and column positions, a handle, and two spin reels, one reel corresponding to a row position number and one reel corresponding to a column position number. The game is played by causing the machine to spin one or both of the reels in an attempt to match the numbers on the fixed display matrix. However, the game does not use random bingo cards typically found in the game of bingo and relies on the player's skill in attempting to stop the spinning reels at the right time to win the game. Accordingly, it is believed that the machine disclosed in U.S. Pat. No. 4,743,024 fails to recreate the fun and enjoyment associated with the game of bingo. Further, the disclosed machine cannot be played by more than one player.

Accordingly, it is an object of the present invention to provide a computer-based system and method for playing a bingo-like game.

It is another object of the invention to provide a computer-based system and method for playing a bingo-like game in which a player may utilize one or more display matrices.

It is another object of the present invention to provide a computer-based system and method for playing a bingo-like game in which two or more players may compete against each other.

SUMMARY

It is recognized that bingo may be implemented in a more enjoyable manner to provide both multi-user play and to allow users to have greater selection and strategic interaction with the game as well as to compete with other players.

A device for playing a bingo-style game including an input device for receiving user inputs; a display for displaying a graphic user interface (GUI); and a processor. The GUI includes a five column by five row random number display matrix; five display regions, each display region corresponding to each column of the display matrix; and a plurality of user-actuatable icons, including an actuation icon. The processor responds to the user inputs for executing an application program to cause the display of the GUI. The processor includes a first random number generator for generating five sets of random numbers for display by the five column by five row random number display matrix, in which the five sets of random numbers are generated such that the first set includes random numbers ranging from 1 to 15; the second set includes random numbers ranging from 16 to 30; the third set includes random numbers ranging from 31 to 45; the four set includes random numbers ranging from 46 to 60; and the fifth set includes random numbers ranging from 61 to 75; and each set of random numbers is generated without repetition within the respective set. The processor also includes a second random number generator, comparing means, and determining means.

The second random number generator responds to the user inputs corresponding to actuation of the actuation icon by the user for generating a sixth set of random numbers for display by the five display regions. The comparing means compares the sixth set of random numbers displayed in the five display regions with the numbers in the corresponding columns of the display matrix, and, if they match, allows the processor to respond to user inputs corresponding to selected matching numbers, to automatically cover the matching number in the display matrix. The determining means determines whether the display matrix has five numbers covered in a row, five numbers covered in a column, five numbers covered in a diagonal, or all of the numbers are covered, and generates a bingo indication signal for indicating a bingo condition.

BRIEF DESCRIPTION OF THE DRAWINGS

The features of the disclosed computer-based system and method will become more readily apparent and may be better understood by referring to the following detailed description of an illustrative embodiment of the present invention, taken in conjunction with the accompanying drawings, where:

FIGS. 2A–2D are illustrations showing certain winning bingo combinations.

FIGS. 3A–3D are illustrations of various ways to select which boxes within the display matrix are to be covered before playing a one player slot machine embodiment.

DESCRIPTION OF THE PREFERRED EMBODIMENTS

Figure 1:
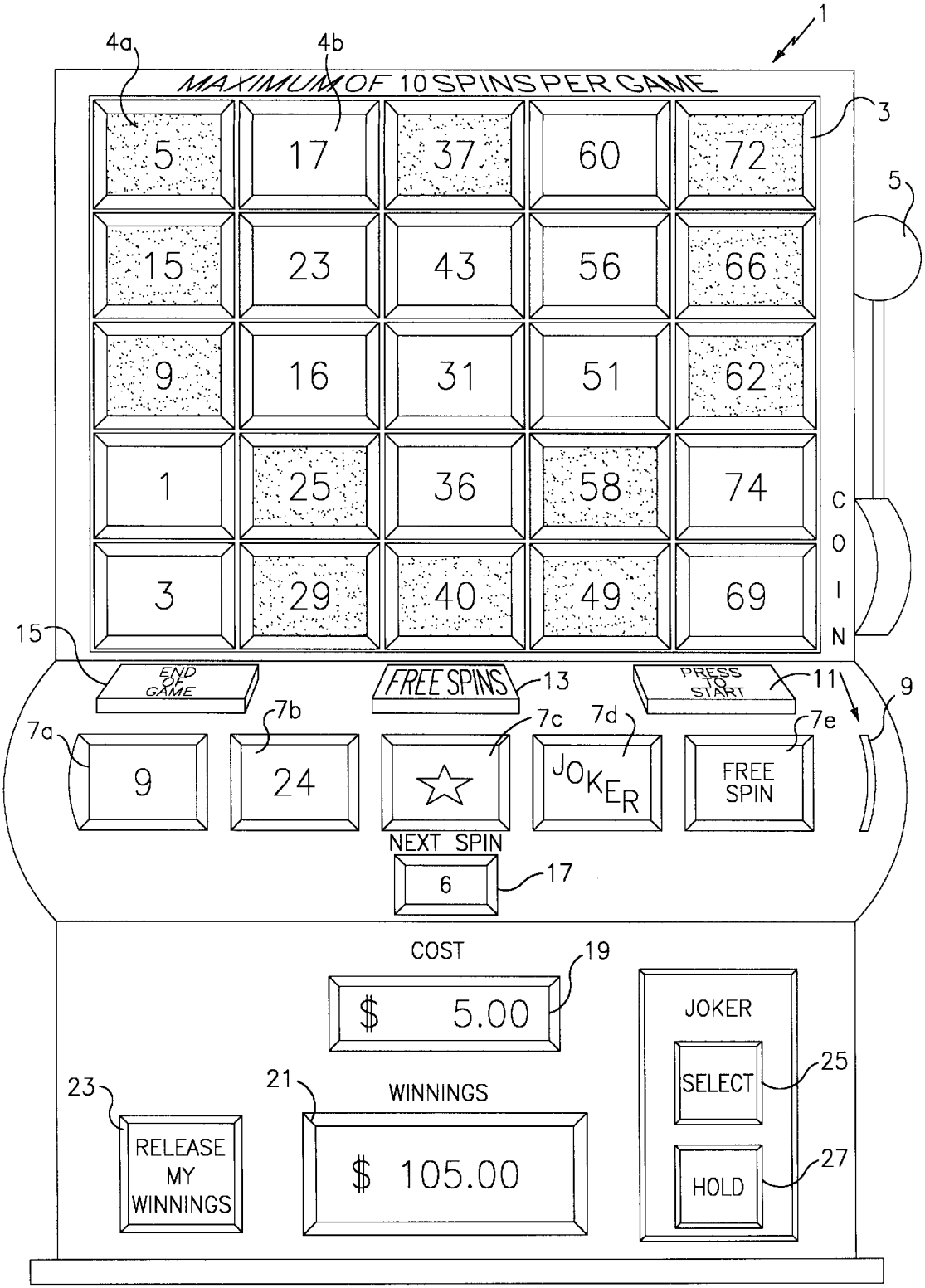
FIG. 1 is a front view of an embodiment of the present invention showing a slot machine designed for playing the game of bingo.

Referring now in specific detail to the drawings, with like reference numerals identifying similar or identical elements, FIG. 1 is a front view of a preferred embodiment of the present invention showing a slot machine design for playing the game of bingo. The slot machine includes display matrix 3 comprised of five rows of blocks by five columns of blocks as would be typically found on a bingo game card. As will become readily apparent to those skilled in the art, the display matrix can be a series of television screens for displaying numbers within each block, a single screen subdivided into blocks for displaying numbers, individual display screens per block, or other display systems as would be found on slot machines, video games, computer systems, and the like. The display matrix is designed so that when activated, random numbers are displayed in each block of the display matrix. Preferably, the numbers range from 1 to 75 and are limited to a specific range within a column of blocks. For example, of the five blocks corresponding to the first column of the display matrix, the possible numbers available for each block would range from 1 to 15. The second column of blocks would range from numbers 16 to 30, the third column of blocks would range from numbers 31 through 45, the fourth column would range from numbers 46 through 60, and the fifth column would range from numbers 61 through 75. As in the game of bingo, the machine is designed such that no number will appear twice within the display matrix.

The machine is also configured with a slot machine activating arm 5 and coin slot 9 as would be typically found in a slot machine. Further, the machine includes five separate slot machine wheels (not shown) each having a display window, 7*a*, 7*b*, 7*c*, 7*d*, and 7*e*. Each wheel and window correspond to a column of the display matrix 3. Therefore, the first wheel and window 7*a* would correspond to the first column of the display matrix, the second wheel and window 7*b* would correspond to the second column, and so forth. Modifications to existing five wheel slot machines, for example the Bally Manufacture Corporation's five wheel slot machines model Nos. 1019-1 and 1019-222, are possible but preferably, a custom slot machine design would be used to implement the present invention.

The machine also includes a "Free Spin" combination display light and button 13 and an "End Of Game" display light 15. Other combination display light and buttons on the machine include a "Press To Start" button 11, Joker "Select" and "Hold" buttons 25 and 27 respectively, and a "Release My Winnings" button 23. Further, in addition to the five wheel display windows, there is a "Next Spin" window 17, a "Cost" per spin window 19, and a cumulative "Winnings" window 21.

Each wheel corresponding to display windows 7*a*–7*e* includes a range of numbered positions which corresponds to the range of numbers within each column. For example, the first wheel corresponds to the first column of the display matrix and includes numbered positions in the range of the first column, that is, positions numbered 1 through 15. Similarly, the second wheel corresponds to the second column and includes positions numbered 16 through 30, the third wheel corresponds to the third column and includes positions numbered 31 through 45, the fourth wheel corresponds to the fourth column in the display matrix and includes positions numbered 46 through 60, and the fifth wheel corresponds to the fifth column and includes positions numbered 61 through 75.

It has been found that a bingo game played on the slot machine in this and similar embodiments can be enhanced when the wheels include special positions in addition to the numbered positions. Examples of special positions which have been found to enhance the game include a "Free Spin" position, as shown in window 7*e*, which would allow the player an extra spin if displayed, a lose winnings or "Devil" position (not shown) which would immediately eliminate any cumulative winnings, a "Gold Star" position, as shown in window 7*c*, which would allow the player additional winnings if displayed, a "Lemon" position (not shown) which has a null value, and a "Joker" position, as shown in window 7*d*, which would allow a player to select any uncovered block within the display matrix column corresponding to the wheel. In a preferred embodiment, the first, third, and fifth wheels would each include positions for three Jokers, one Gold Star, and one Lemon, and the second and fourth wheels would each include positions for two Jokers, one Free Spin, one Devil, and one Gold Star. Accordingly, each wheel would have a total of twenty possible positions. The following Table 1 summarizes the positions on each wheel:

TABLE 1

| 1st Wheel Positions | 2nd Wheel Positions | 3rd Wheel Positions | 4th Wheel Positions | 5th Wheel Positions |
|---|---|---|---|---|
| 1 thru 15 | 16 thru 30 | 31 thru 45 | 46 thru 60 | 61 thru 75 |
| 3 Jokers | 2 Jokers | 3 Jokers | 2 Jokers | 3 Jokers |
| 1 Gold Star | 1 Gold Star | 1 Gold Star | 1 Gold Star | 1 Gold Star |
| 1 Lemon | 1 Devil | 1 Lemon | 1 Devil | 1 Lemon |
| | 1 Free Spin | | 1 Free Spin | |

Further, it has been found that increasing the cost per spin as the game is played adds to the excitement of the game. An example increase schedule which has been found to work well is: five dollars for the first through fifth spins, ten dollars for the sixth and seventh spins, and twenty dollars for the eighth, ninth and tenth spins. As discussed below, no more than ten spins are possible. To alert the player of the increasing cost per spin, the cost for the next spin is displayed in the Cost window 19.

With the above in mind, playing bingo on the apparatus of the present invention can now be described. The object of the game is to match and cover all the numbers on the display matrix with a maximum of only 10 spins. There are 13 possible winning combinations: covering a complete row of five blocks (five combinations), covering a complete column of five blocks (five combinations), and covering a diagonal line of five blocks in either direction (two combinations), or completely covering the entire display matrix. FIGS. 2A, 2B, 2C, and 2D show respectively example horizontal, vertical, and diagonal winning combinations. As will become readily apparent to those skilled in the art, additional or fewer possible winning combinations can be used.

To begin playing the game, a player presses the Press To Start button 11 which causes the machine to activate the display matrix and generate 25 random numbers in each of the blocks of the display as discussed above. After the display matrix displays a new set of randomly chosen numbers and the player decides to play, the player must insert a coin or chip to the coin slot 9. If for any reason the player does not begin to play, the numbers on the screen return to a random flashing mode after approximately 16 seconds.

After inserting a coin or chip, the machine will then "cover" preferably 12 blocks of the display matrix before the first spin. It has been found that providing a player with 12 pre-covered blocks enhances the game playing by increasing the odds in favor of the player. Further, it has been found that it is preferred that the machine, in deciding which of the 25 blocks within the matrix to cover, does not cover more than three blocks in any column or row and not more than two blocks in any diagonal line. Further still, it has been found that the particular pattern shown in FIG. 1 and FIG. 3A, wherein the first three blocks of the first and fifth columns are covered, the last two blocks of the second and fourth columns are covered, and the first and last blocks of the third column are covered, enhances the odds of winning and makes the game more exciting to play. As will become readily apparent to those skilled in the art, the symmetrical pattern shown in FIG. 1 and FIG. 3A can be inverted as shown in FIG. 3B or rotated 90 degrees in either direction as shown in FIG. 3C and FIG. 3D and still result in the same enhanced game excitement.

After the display matrix pre-covers 12 blocks, the Next Spin window 17 then lights up with a message "Ready To Play" and the player can now pull the arm 5 to start the game. Pulling the arm 5 causes the five wheels to begin spinning in a known slot machine type manner. Further, the Next Spin window 17 will advance one number and the Cost window 19 is updated to indicate the required amount to be inserted before another spin can be taken. The game has a maximum of 10 spins including any free spins taken. After 10 spins, the game is over and the End of Game light 15 will flash.

After the five wheels spin for a period of time, the machine stops the wheels at a randomly selected position such that one of the twenty possible wheel positions are displayed in each wheel's respective display window 7*a*–7*e*. If a selected numbered wheel position matches a number within the wheel's corresponding column in the display matrix, that number in the display matrix column will then be covered. Thus, for example, if the first wheel displays a number which corresponds to a number in the first column of the display matrix, that number in the display matrix is then covered. Similarly, if the second wheel displays a number which corresponds a number to the second column of the display matrix, that number in the second column of the display matrix is covered, and so on for the third through fifth wheels.

If a Free Spin position is displayed, a light in the Free Spin combination display light and button 13 lights up. Preferably, a player is allowed to accumulate two free spins on any pull of the arm. Accordingly, two lights can be used within the Free Spin button 13 to show the availability of up to two free spins. If a player decides to use a free spin, the player merely presses the free spin button instead of inserting a coin or chip and pulls the arm 5 as discussed above.

If a Joker position is displayed by a wheel, the player then has the option to select which of the blocks within the column corresponding to the Joker is to be covered. Specifically, by pressing the Select button 25, the player can select through the available uncovered numbered blocks within the corresponding column until the particular block the player is interested in is covered. The player then presses the Hold button 27 to select the block. For example, if the player received a Joker in the fourth column as shown in FIG. 1, the player would press the Select button 25 which would then cause the number 60 block to be covered. By pressing the Select button 25 again, the number 56 would be covered. By pressing the Select button 25 yet again, the number 51 would be covered. By pressing the Select button 25 yet again, the number 60 would then be re-covered and so on until the player decides which number block is to be covered by pressing the hold button 27.

After the spin is complete and the player has selected which block to cover if there is a Joker, the machine then determines whether the player has a bingo combination, that is, whether five blocks either in a row, in a column, or diagonally are now covered. If the player does have a bingo combination, the machine automatically updates the winnings window 21 with the winnings associated with the particular bingo combination.

All prize money won from each spin accumulates and is displayed in the winnings window 21. A player can take their winnings after any spin, ending the game, by pressing the Release My Winnings button 23.

It has been found that the following winnings schedule provides a balance between winning, losing, and investing in each spin: five dollars for each number covered; five dollars for each Gold Star; twenty dollars for each five block row, column, or diagonal combination; fifty dollars for two diagonal combinations; one hundred dollars for filling the display matrix in 10 spins; five hundred dollars for filling the display matrix in 9 spins; one thousand dollars for filling the display matrix in 8 spins; five thousand dollars for filling the display matrix in 7 spins; ten thousand dollars for filling the display matrix in 6 spins; and twenty five thousand dollars for filling the display matrix in 5 spins.

As will become readily apparent to those skilled in the art, more than one display matrix can be implemented on a single machine to allow a player to play more than one bingo display. This embodiment would allow further mimicking of the typical game of bingo where a bingo player often plays more than one bingo card to increase the chance of winning.

Figure 4:
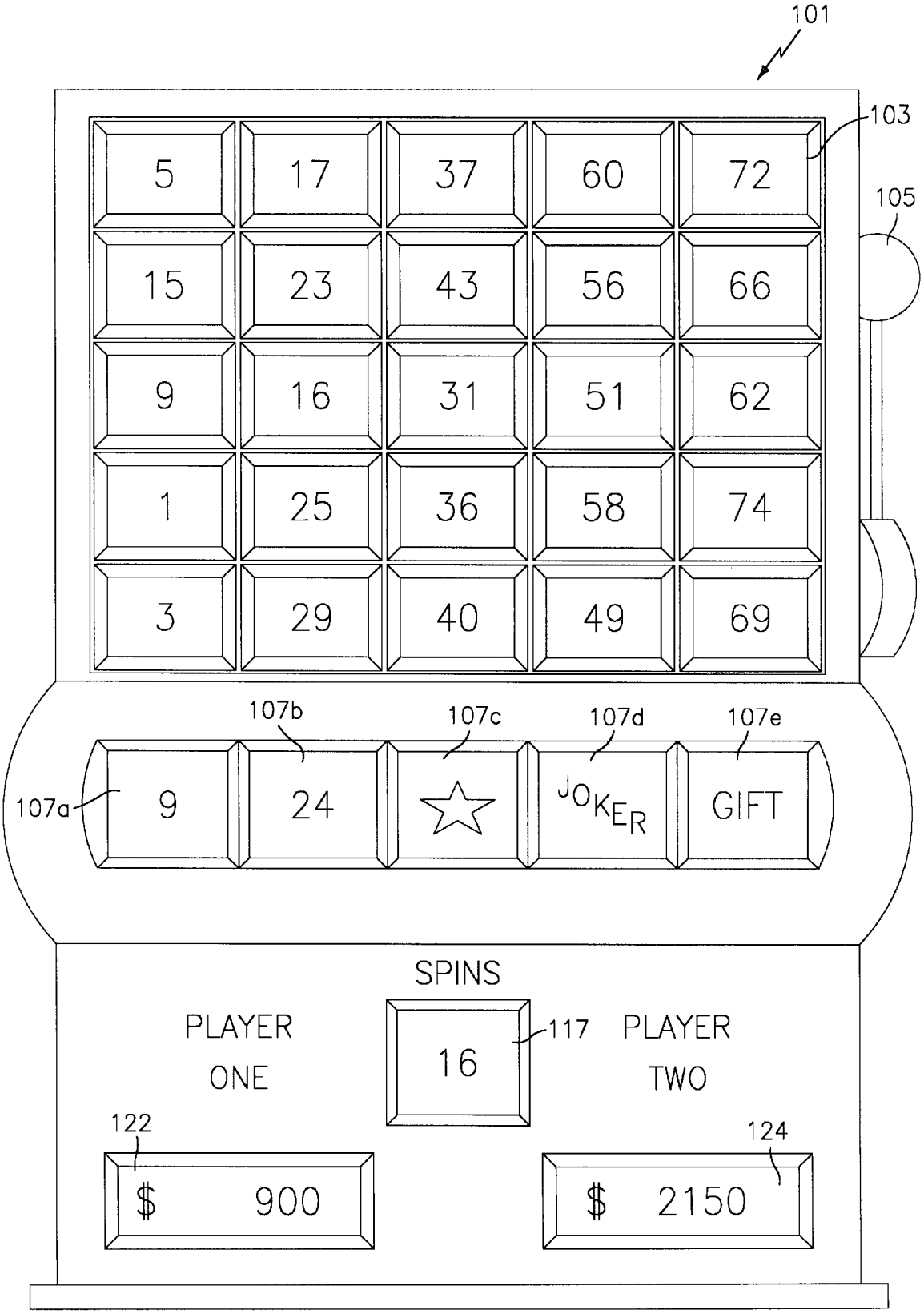
FIG. 4 is a front view of an alternate embodiment of the present invention showing a slot machine designed for playing the game of bingo with two or more players.

FIG. 4 illustrates an alternative two-player embodiment. Specifically, FIG. 4 is an illustration of a embodiment of the present invention for use in a television game show. The bingo slot machine 101 includes a display matrix 103, an activating arm 105, wheel position display windows 107*a*–107*e*, a number of spins window 117, and two player cumulative winning windows 122 and 124.

This embodiment is played in a similar manner as described above. However, instead of 12 pre-covered positions, the display matrix 103 is completely uncovered at the beginning of the game. Further, the maximum number of spins is 16 plus additional free spins not to exceed a total of 20 spins per game. Finally, other special wheel positions, for example a free gift as shown in wheel display window 107*e*, can be used as is typical in the revision game shows.

The following Table 2 lists the various wheel positions for a preferred embodiment of the two player game.

TABLE 2

| 1st Wheel Positions | 2nd Wheel Positions | 3rd Wheel Positions | 4th Wheel Positions | 5th Wheel Positions |
|---|---|---|---|---|
| 1 thru 15 | 16 thru 30 | 31 thru 45 | 46 thru 60 | 61 thru 75 |
| 3 Jokers | 3 Jokers | 3 Jokers | 2 Jokers | 3 Jokers |
| 1 Gold Star | 1 Gold Star | 1 Gold Star | 1 Gold Star | 1 Gold Star |
| 1 Gift | 1 Devil | 1 Free Spin | 1 Devil | 1 Gift |
| | | | 1 Free Spin | |

In the two or more player embodiment, the object of the game is to win the most money. As with the single player embodiment, there are various ways to win money: cover a vertical or horizontal line of blocks in the display matrix, cover a diagonal line of blocks in the display matrix, cover all of the blocks in the display matrix, spin a Gold Star, or spin a Free Gift. Preferably, a player can only win one free gift per round and will only collect on the gift if the player wins the round. Optionally, the value of the gift can be included in a player's cumulative winnings.

Other differences between the one player and the two-player embodiment rules include the following are: when a player spins a Free Spin, the player must use the free spin immediately or lose it; when a player spins a Devil, only wheels displaying matching numbers or a Joker are valid but no money value is received, all other wheel positions are void and the player's accumulated winnings including gifts are erased.

Further, after 16 spins, including free spins, either player can buy additional extra spins at a preferred rate of one-hundred dollars per spin assuming the player has accumulated more than $100.00 and no more than twenty spins in total have not taken place.

The game is played in a series of rounds, preferably three, with each player accumulating winnings. After three rounds, the player with the highest winnings is allowed to keep his winnings and advance to a single player final round. The values for receiving a winning combination change between the rounds. In the first round, the preferred winning schedule is: fifty dollars for each numbered covered, two-hundred and fifty dollars for each line covered (vertical, horizontal, or diagonal) or Gold Star received, and one-thousand dollars for covering the entire display matrix. The cost of an extra spin is one-hundred dollars. In the second round, the preferred winning schedule is: one-hundred dollars for each number covered, five-hundred dollars for each line covered or Gold Star received, and two-thousand dollars for covering the entire display matrix. The cost of an extra spin is two-hundred dollars.

In the third round, the preferred winning schedule is: two hundred dollars for each number covered, one-thousand dollars for each line covered or Gold Star received, and four-thousand dollars for covering the entire display matrix. The cost of an extra spin is three hundred dollars.

The fourth and final round is played by the player with the highest accumulated winnings after the three rounds. The winning player plays the final round using the same machine except that before the player plays the game, twelve blocks are covered, preferably in a manner as described above and illustrated in FIGS. 3A–3D. Further, the player is only allowed ten spins, including the use of an acquired or previously accumulated free spins, provided the player has not lost same by spinning a Devil position. The final round player can also buy up to three spins from the player's accumulated winnings: the first spin costing five-hundred dollars, the second spin costing one-thousand dollars, and the third spin costing one-thousand five-hundred dollars. Further, the winning schedule changes: two-thousand five-hundred for each Gold Star, five-thousand dollars for covering both diagonals, and twenty-thousand dollars for covering the entire display matrix. If the player spins a Gift position, the player receives gifts that were not won in the previous three rounds.

Alternate variations on the game can be made. For example, one can vary the number of spins, the number of purchasable extra spins, and/or the amount of money awarded for winning combinations. In a preferred alternate final round, the final player can have sixteen spins and purchase four additional spins for a maximum of twenty free spins. In this embodiment, the first extra spin would cost four-hundred dollars, the second free spin would cost six-hundred dollars, the third flip spin would cost one-thousand dollars, and the fourth free spin would cost two-thousand dollars.

As will become readily apparent to those skilled in the art, variations of the present method and apparatus can be designed and built without departing from the scope of the claimed invention. For example, various embodiments can be fully incorporated into software and played on a computer or similar device. Alternatively, various embodiments may be implemented as a video game or hand-held video game with the program implemented as an integrated circuit game card, CD-ROM, or other similar video game format.

Alternative Embodiments

Figure 5:
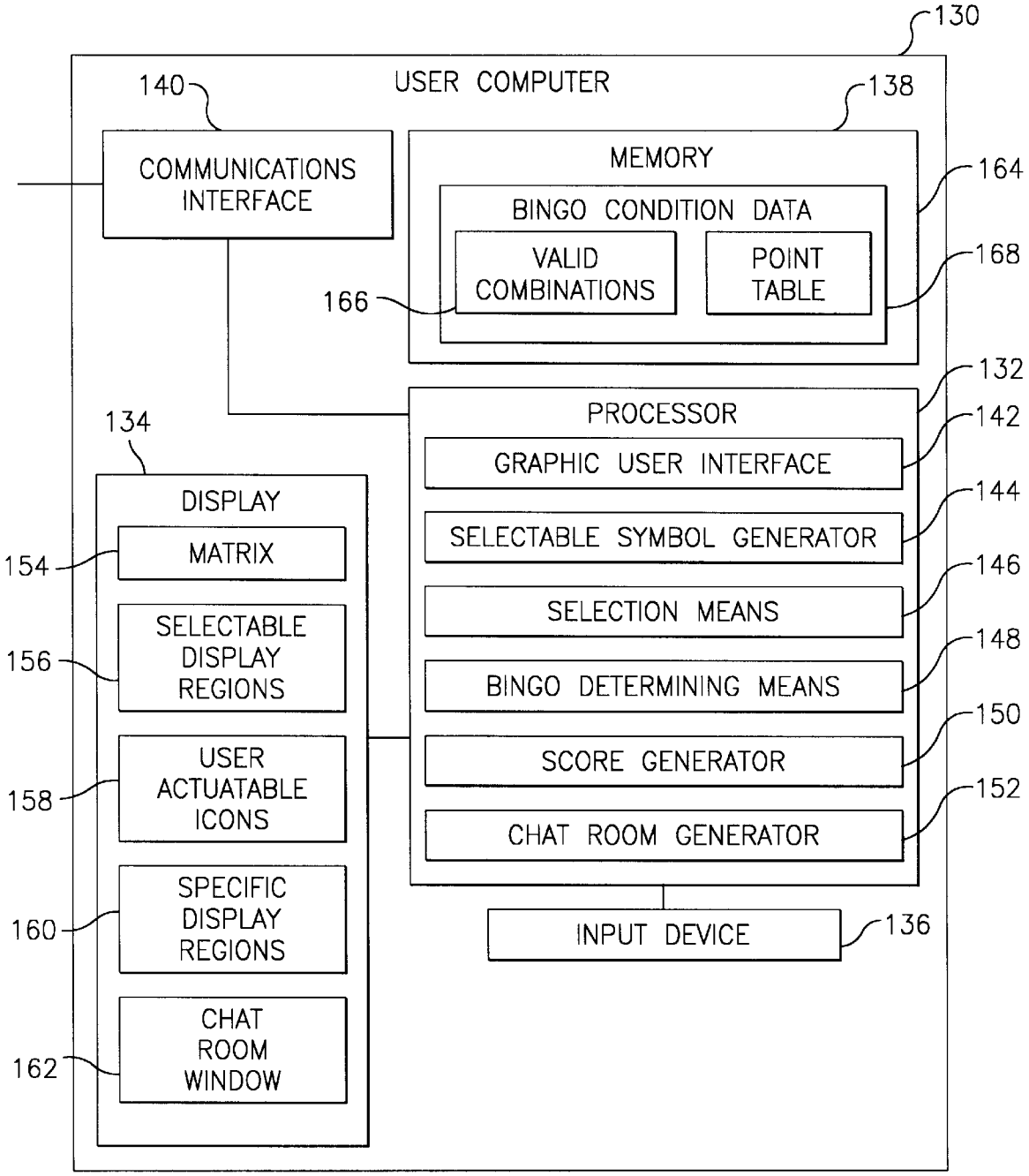
FIG. 5 is a schematic of the disclosed computer-based stand-alone device for playing a bingo-like game.

As shown in FIG. 5, an alternative embodiment of the apparatus and method for playing the bingo-like game includes a stand-alone computer-based device 130 for playing a bingo-like game using graphically displayed symbols. The term "symbol" is herein defined as a graphical representation of bingo numbers, as well as special graphical symbols or pictures representing a joker, a gold coin, a devil, or text such as FREE SPIN. Preferably, the symbols include indicia corresponding to bingo numbers ranging from 1 to 75, which are typically subdivided into five sets of numbers for each of five columns in a bingo-card matrix, as described above.

In a preferred embodiment, the device 130 includes a processor 132, a display 134, an input device 136, and a memory 138. The device 130 may be a personal computer with the processor 132 being a microprocessor as a CPU. In a preferred embodiment, the device 130 may be a personal computer using an 80386 class microprocessor available from "INTEL" and operating, for example, at 50 MHz clock speeds. The display 134 may be a VGA monitor providing a 640×480 pixel image with 235 color resolution, and the input device 136 includes a keyboard and/or a mouse. The memory 138 may include 1 MB of RAM and a 5 MB hard drive. Optionally, a speaker as well as a sound card may also be included for generating sound effects such as background music and/or predetermined sounds in response to specific events occurring during play of the bingo-like game.

For network and multi-player operation, the device 130 may include a communications interface 140 to adapt the device 130 from a stand-alone device for playing the bingo-like like game to a terminal for such multi-player operations to play the bingo-like game in conjunction with other players, which is described in greater detail below.

The processor 132 operates an application program, stored in the memory 138 and generated from source code written, for example, in C++. In use, the processor 132 executes the application program to generate a graphic user interface (GUI) 142, for example, using "WINDOWS" 3.1, "WINDOWS 95", or "WINDOWS NT", available from MICROSOFT.

The processor 132 includes a selectable symbol generator 144 for randomly generating symbols. In operation, the device 130 allows the user to play the bingo-like game for a series of turns. In the preferred embodiment, for each user, the selectable symbol generator 144 generates a set of five randomly generated symbols which are displayed to the user by selectable display regions, as described below.

In generating such random symbols, each of the symbols, for example, may be assigned a unique number, and random number generating techniques known in the art may be used to generate random numbers from the set of unique numbers. For example, a random number generating method associated with a GNU C compiler available from the FREE SOFTWARE FOUNDATION may be used.

Using such random numbers, the corresponding random symbols may be generated therefrom. In addition, the random number generating techniques may be biased, such that a predetermined set of symbols have a predetermined probability of occurrence. For example, the symbol corresponding to a joker may be set to be generated once in every 10 rolls, while each symbol of each set of 15 bingo number per matrix column may be set to be generated once in every 20 rolls. Such biased symbol generation enhances the play of the bingo-like game.

In addition, the selectable symbol generator 144 may also be set to generate such random symbols, for each user, without repetition within any single turn, or alternatively without repetition within any single game session of each user. A game session is herein defined as a set of turns for a single player. Alternatively, repetition of symbols during a game session may be a option selectable by the user to further enhance playing of the bingo-like game.

In a further alternative embodiment, the user may set the bingo-like game to only generate symbols corresponding to standard bingo numbers, and accordingly to prevent generation of special symbols such as a joker, a devil, etc. With such a setting to generate only such symbols corresponding to a standard bingo numbers, the selectable symbol generator 144 may have the probability of generating each symbol per column set to 1/15; i.e. each symbol corresponds to one unique bingo number in a 15 number range of bingo numbers per column.

The processor 132 also includes selection means 146 to receive and process user inputs from the input device 136 to select a symbol in the matrix to be covered. Such user inputs may include signals generated by a mouse as the input device 136 to perform "drag-and-drop" operations known in the art. For example, the user may select a displayed symbol by "clicking" on the symbol using a cursor positioned thereupon, in a manner known in the art, and "dragging" the symbol; i.e. a graphical representation and/or replica, of the symbol to a matching number a specific position in the displayed matrix. The GUI 142 processes and performs such user inputs and display commands in a manner known in the art.

The processor 132 also includes bingo determining means 148 for accessing the memory 138 to determine if a set of displayed symbols in the horizontal rows, vertical columns, or main diagonals of the displayed matrix correspond to a valid bingo condition as described below.

The processor 132 also includes a score generator 150 to generate a score of points awarded for attaining valid bingo conditions. The processor 132 may optionally include a chat room generator 152 for operating in a chat room mode for text transfer and receipt during multi-player operation, as described below.

The display 134 displayed a GUI screen or window which includes a graphically generated matrix 154 having columns and rows of display regions defining blocks. The display 134 also includes a set of selectable display regions 156, which display the set of five randomly generated symbols. A plurality of user actuatable icons 158 are also displayed, for example, a QUIT icon to quit the bingo-like game, a SOUND toggle icon to toggle the generation of sound effects, and a CHAT toggle icon to toggle display of a chat room window.

The display 134 also displays specific display regions 160, such as a spin window and a points display window. The display may also optionally display a chat room window 162.

The memory 138 stores bingo condition data 164 including a database 166 of valid bingo conditions, such as combinations of bingo numbers in the matrix 154 being five contiguous numbers in a row, in a column, or in a main diagonal. Alternatively, the bingo determining means 148 may utilize a bingo determining technique using classification methods known in the art to evaluate sets of symbols as representing a bingo condition.

The memory 138 may also include a point table 168 for storing a predetermined set of point values associated with each valid combination of symbols representing bingo conditions. In a preferred embodiment, the following point schedule provides a balance between winning, losing, and strategically placing symbols to complete bingo conditions in each spin: 100 points for each row, column, or main diagonal of five bingo numbers; and 2000 points may also be obtained for completely filling the matrix 154.

Figure 6:
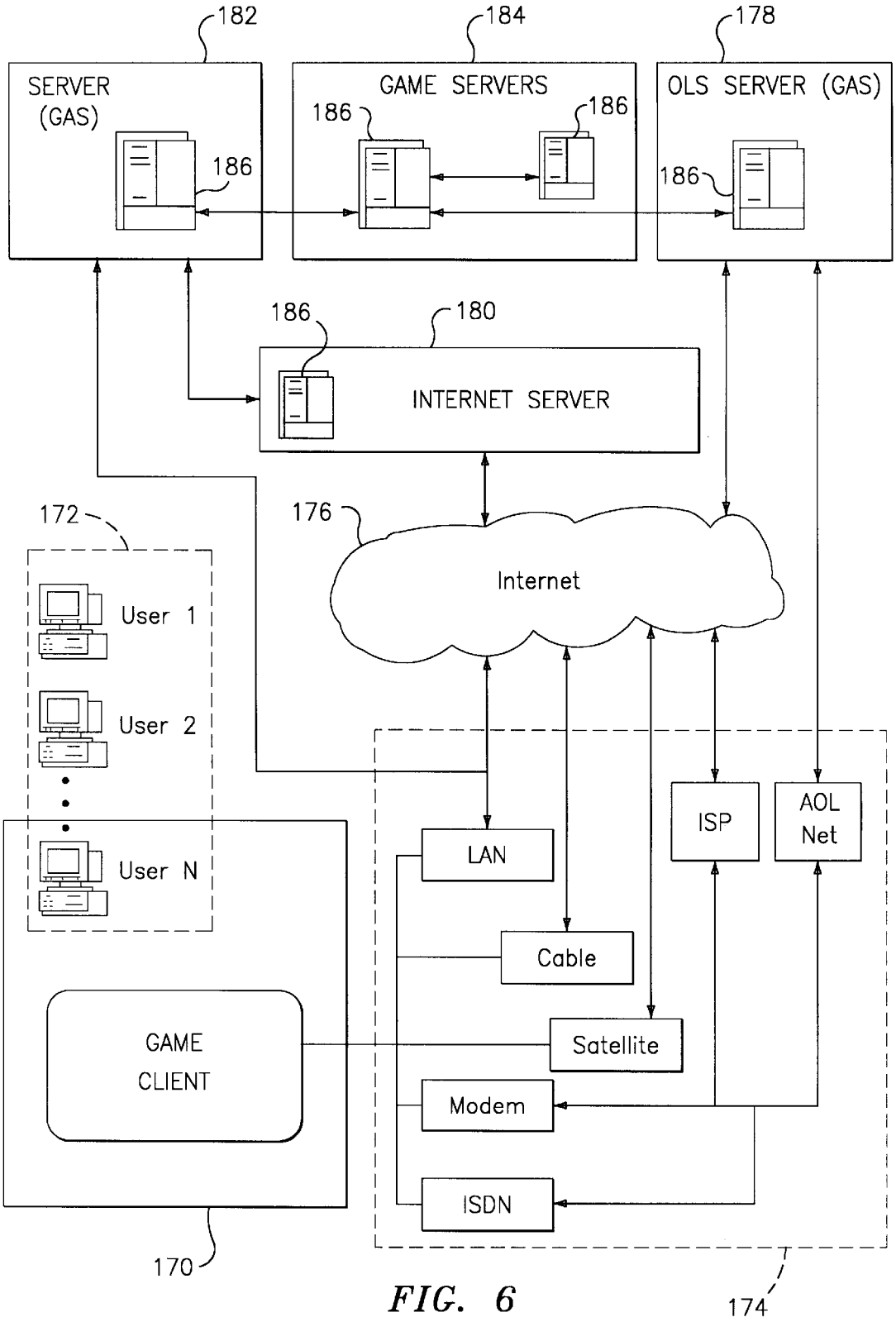
FIG. 6 is a schematic of the disclosed computer-based system using a network configuration for playing a bingo-like game.

As shown in FIG. 6, for networked and/or multi-player operation, the disclosed computer-based system includes a game client 170 for interfacing with at least one user through user terminals 172. Each user terminal 172 may be the computer 130 shown in FIG. 5 or may be "dumb" terminals for on-line use. For example, such "dumb" terminals may merely process user inputs and receive and display data from the game client 170, with the processing capabilities for performing the bingo-like game being located solely at the game client.

Referring to FIG. 5, the communications interface 170 may include a 14.4 Kbaud modem operatively connected to the processor 132 through at least one port, such as a serial port, with the modem connected to outside telephone lines to the network through the game client 170. The communication interface 140 may operate in conjunction with other hardware and/or software included in the device 130, such as on-line interface software or Internet software available from an on-line service (OLS) such as "AMERICA ON-LINE", or from an Internet service provider (ISP) such as "THE MICROSOFT NETWORK", in which the Internet is a network of computer networks linked by telephone lines, leased lines, fiber optic cables, and copper wires; and including at least five million host computers which are accessed daily by about twenty million people world-wide. The Internet also includes gateways to OLSs as well as graphic and multimedia portions such as the World Wide Web (WWW), E-mail facilities, and file transfer protocol (FTP) and CGI facilities.

The disclosed computer-based system includes network connections 174 including, but not limited to, a modem or an integrated services digital network (ISDN) connection to an OLS network; a T1 line, a coaxial cable connection to a cable system interface and/or a cable modem, a local area network (LAN) or other networks such as a wide area network (WAN) or medium area network (MAN), a satellite link, or an ISP connection to the Internet 176. The game client 170 may be connected through an OLS or through the Internet to an OLS server 178.

Such OLS servers 178 may be E class Hewlett Packard (HP) machines using a PA RISC CPU and having about 256 MB of RAM, a 1 GB hard drive, and a fiber optic network interface card such as FDDI, and utilizing an HPUNIX v.9.05 operating system.

Alternatively, the game client 170 may be connected through an Internet server 180 to a proprietary server 182. In another alternative embodiment, the game client 170 may be connected through the LAN connection directly to the proprietary server 182. Such LANs may be implemented in a casino, a boat, an airplane, a restaurant, a space station, etc.

The OLS server 178 and the proprietary server 182 are connected to a set of game servers (GAS) 184 which manage a plurality of concurrent single player and/or multi-player games. Each of the servers 178–184 includes a respective server processor 186 having appropriate server hardware, software, and interfaces for providing the appropriate communication protocol for establishing a connection between the users 172 and the set of game servers 184.

Figure 7:
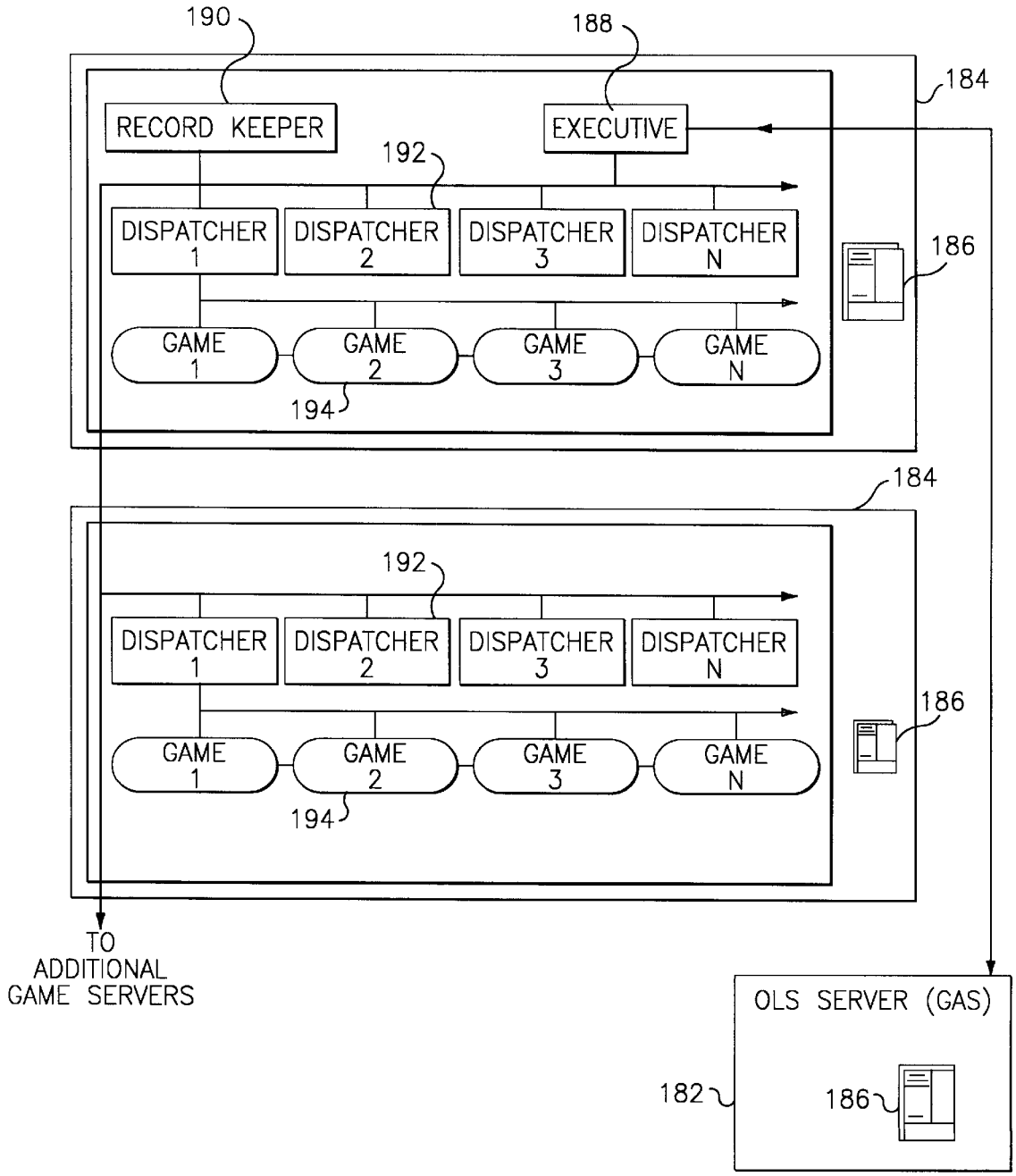
FIG. 7 is a schematic of a game server.

In a preferred embodiment, as shown in FIG. 7, the set of game servers 184 includes the server processor 186 for controlling an executive function 188, a records keeper function 190, and a plurality of dispatcher modules 192, with each dispatcher module interfacing with a plurality of software modules each operating the bingo-like game 194 for a respective user. As shown in FIG. 7, one of the set of game servers 184 may be connected to an OLS server 182 and to other game servers to perform as a primary game server for maintaining the executive function 188 and the record module 190 which coordinate operations of all of the set of game servers 184.

Figure 8:
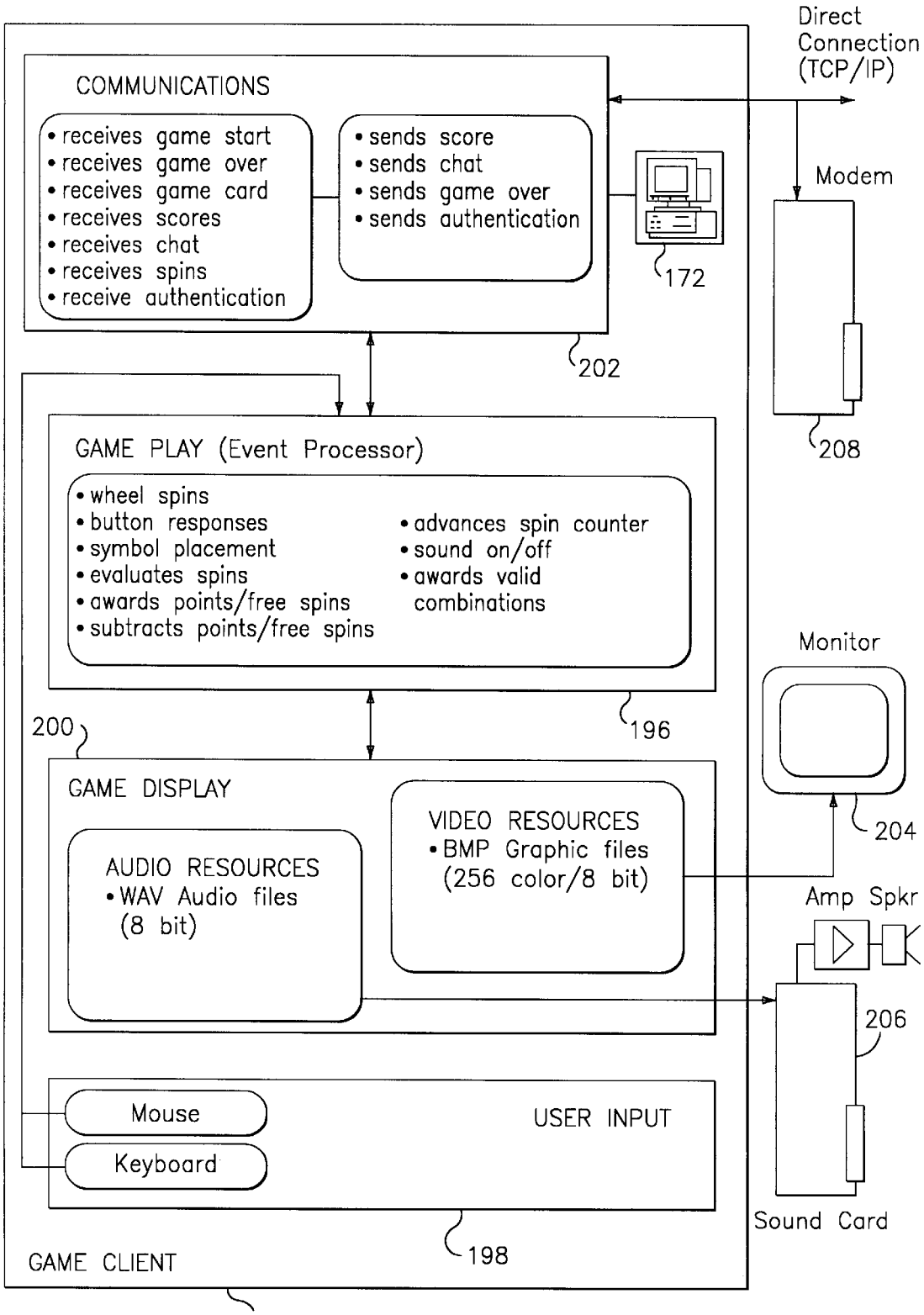
FIG. 8 is a schematic of a game client.

As shown in FIG. 8, the game client 170 includes an event processor 196 connected to a user input device 198, a game display 200, and a communications interface 202. The event processor 196 operates the application program for allowing the user to play the bingo-like game. The event processor 196 performs wheel spins; i.e. the event processor 196 operates the selectable symbol generator to generate a new set of five random symbols and to change a current display of the selectable display regions to display the generated random symbols to simulate the spinning of multiple mechanical wheels generating random symbols as in slot machines in the prior art.

The event processor 196 also generates button responses; i.e. the processing of actuations of user-actuated icons. The event processor 196 also performs symbol placement; i.e. the event processor responds to user selections of the selectable display regions to place a symbol into the matrix 154, for example, by dragging and dropping a graphic depiction of the selected symbol to a specific matrix display region. The event processor 196 also evaluates spins; i.e. the actuation of an actuation icon to generate the new set of five random symbols to determine, for example, whether the special symbols for a joker, for a devil, for a free spin, or for a gold coin are generated.

In response to evaluating spins, the event processor 196 awards or subtracts points and/or free spins as appropriate, for example, for the substraction of points due to a devil symbol being generated, or for the awarding of points from the selective placement of symbols on the matrix 154 to generate a valid bingo combination.

The event processor 196 also awards valid symbol combinations; i.e. corresponding to bingo conditions, as well as the occurrence of a special events; for example, the filling up of the entire matrix 154 with symbols, which causes bonus points to be added. In response to user inputs, the event processor 196 also advances a spin counter and toggles sound to be on or off.

The user input 198 of the game client 170 may also include a mouse or keyboard, as well as signals remotely received from a mouse or keyboard of the users using the user terminals 172.

The game display 200 of the game client 170 provides video resources, such as predetermined graphics files, for example, as bit-map (BMP) and GIF files, to provide 256 color and 8 bit images for use in the GUI to display, for example, the various bingo numbers as well as the special symbols, such as the joker and the gold coin, on a monitor 204. The game display 200 may also include audio resources such as 8 bit WAV audio files to generate game sounds through a sound card 206 connected to the speaker and/or amplifier of each of the user terminals 172. Such game sounds may include predetermined background music, a gold coin spilling sound which is generated and output in response to the generation of a gold coin symbol in the new set of selectable symbols, or a flipping sound as the new set of selectable symbols are generated and displayed in the selectable display regions, to simulate movement of wheels as in slot machines of the prior art.

The communications module 202 performs communication protocols between the event processor 196 and the game servers 184 through, for example, a direct connection 208 such as a TCP/IP connection or a modem. The communications module 202 receives control and data signals corresponding to the start of a game session; to the end of a game session; and to the generation of a game card, i.e. the transition at the beginning of the game from an introductory screen and/or chat room window to the matrix 154. The received control and data signals may also include received chat signals, i.e. data corresponding to text from other users in a chat room mode; signals indicating the number of spins/turns played by each user; and received authentication signals, for example, in security and/or pay-to-play configurations.

The communications module 202 also provides the appropriate protocols to send the current score of each user to the game server, for example, to maintain a high score table; to send chat signals, i.e. data corresponding to text from a user to other uses in a chat room mode; to send a game termination signal from a user to quit the game; and to send an authentication signal to verify the user, for example, in security and/or pay-to-play configurations.

Figure 9:
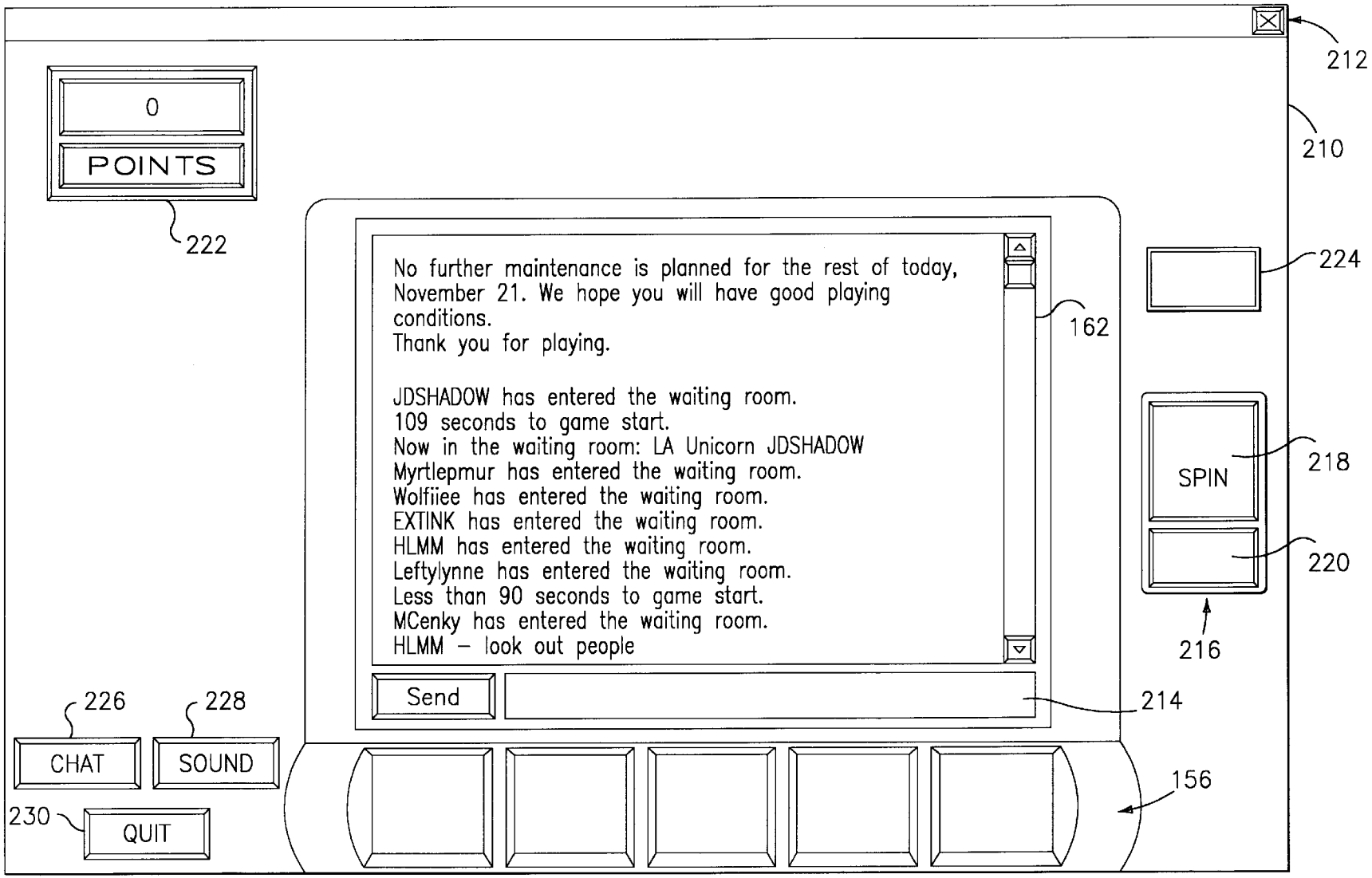
FIG. 9 is a display screen including a large chat room window.

As shown in FIG. 9, in both the stand-alone configuration for single player use shown in FIG. 5 and the multi-player configuration shown in FIGS. 6–8, the computer-based system and method generates an introductory game screen 210 on the display 134 using the GUI 142. The introductory game screen 210 displays a command bar 212, the selectable display regions 156, and the chat room window 162 which displays introductory messages such as THANK YOU FOR PLAYING or, in the multi-player configuration, announcements of individuals entering a queue of players in a "Waiting Room", as the computer-based system initializes the bingo-like game.

In the multi-player configuration, the chat room window 162 includes a text entry region 214 which displays text entered by a user. Upon activation; i.e. "clicking", the SEND icon, the entered text is sent to be displayed in the stream of chat room text shown in the chat room window 162.

The specific display regions 160 of FIG. 5 include, for example, a spin window 216 which has an actuatable spin icon 218 and a turn indicator 220 which displays the current turn number. The specific display regions 160 also include a point indicator 222 for displaying the current number of points awarded to the user at the end of a current turn, and a time indicator 224 for indicating a countdown of time remaining for a user to make a selection of a symbol from the selectable display regions 156 or from the matrix 154 to cover; i.e. graphically modify, a matching symbol in a corresponding column in the matrix 154.

The user actuatable icons 158 of FIG. 5 include, for example, a chat room toggle icon or CHAT icon 226 for activating and deactivating the display of the chat room window 162; a sound toggle icon or SOUND icon 228 for activating and deactivating the sound effects generated by the computer-based system and method during the game; and a game termination icon or QUIT icon 230 for allowing the user to quit the current game.

Figure 10:
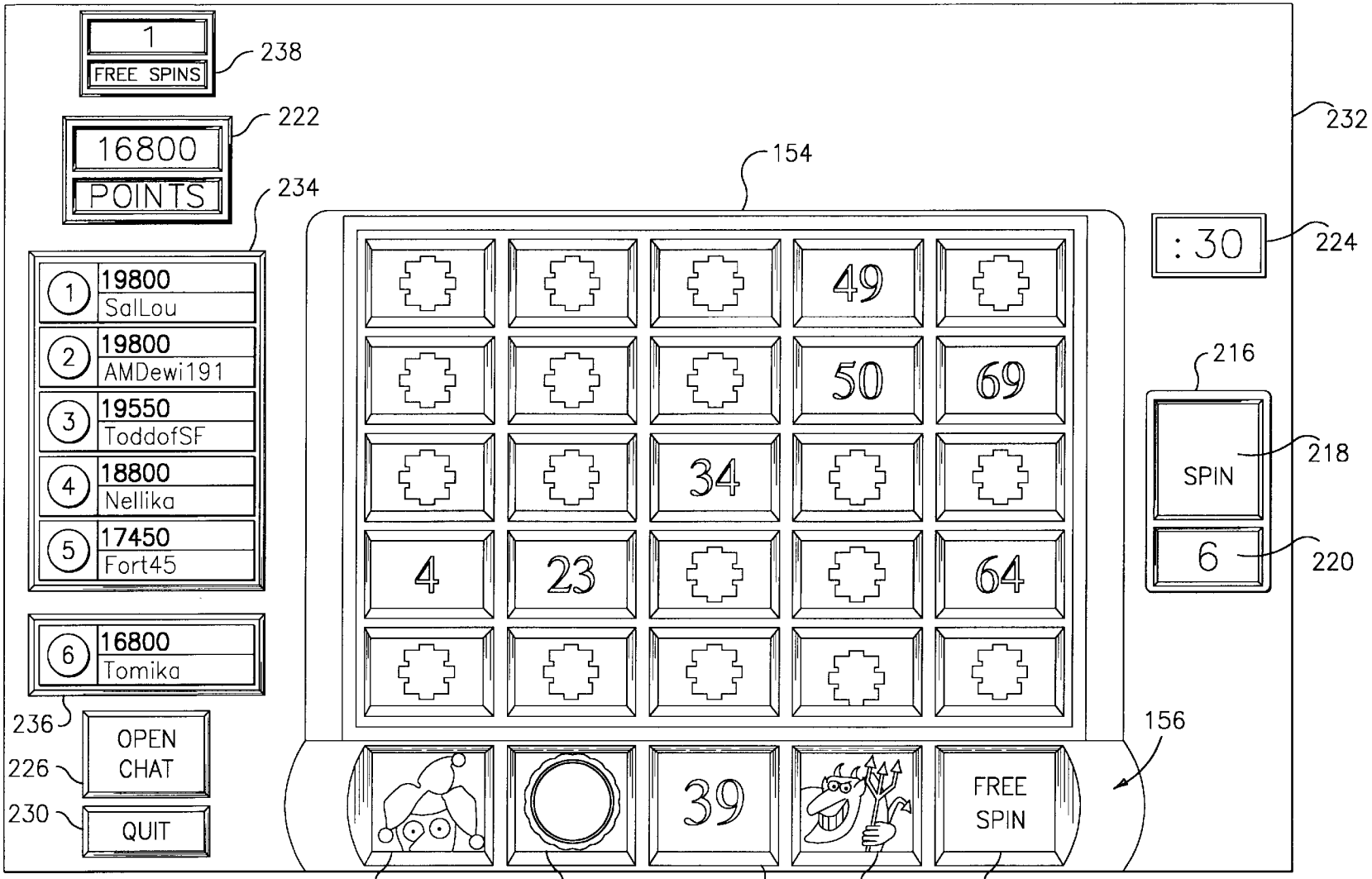
FIG. 10 is a display screen for playing the bingo-like game.

After the bingo-like game has commenced, the matrix 154 and other specific display regions 160 are displayed on an active game screen 232, as shown in FIG. 10. The active game screen 232 differs from the introductory game screen 210 in FIG. 9 in that the chat room window 162 is replaced by the matrix 154, and, in a multi-player configuration, the current scores of all of the players are displayed in a multi-player high score window 234. If the current score of the user viewing the active game screen 232 is less than the scores of a predetermined number of higher ranking scores, then the current score of the viewing user is displayed in a separate viewer score window 236. For example, the disclosed computer-based system may accommodate twenty players in a single game session, and the scores of all of the players are ranked, with only the scores of the top five players being displayed in the high score window 234.

Figure 12:
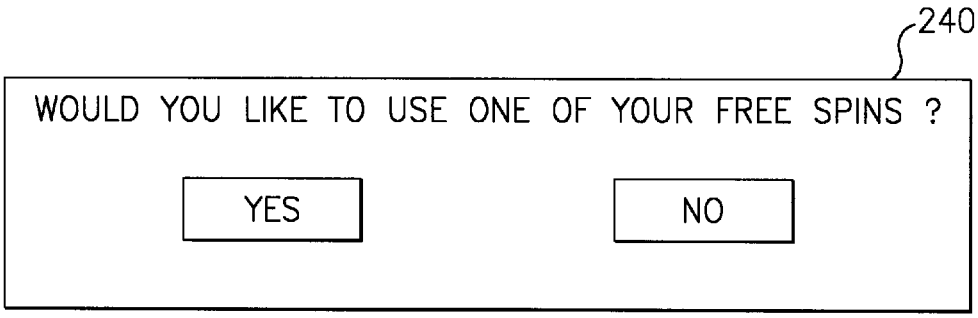
FIG. 12 is a query window.

At the beginning of each turn, if the user viewing the active game screen 232 has earned at least one free spin, the number of free spins is displayed in a FREE SPIN count window 238, and a separate query window 240, for example, as shown in FIG. 12, is displayed overlapping the active game screen 232 to request the viewing user to choose whether to use a free spin, and to enter the choice through the query window 240.

As shown in FIG. 10, after activation of the spin icon 218, the selectable symbol generator 144 generates five random symbols, such as a bingo number 242, and icons including the special symbols, such as an unused joker icon 244, a gold coin icon 246, a devil icon 248, and a free spin icon 250. Such random symbols are then displayed in the selectable display regions 156.

Within the time limit of, for example, thirty seconds, as counted down by the processor 132 and displayed in the time indicator 224, the current viewing user is to select at least one of the displayed symbols in the selectable display regions 156 or alternatively one of the displayed symbols in the matrix 154, or lose the current turn.

Figure 11:
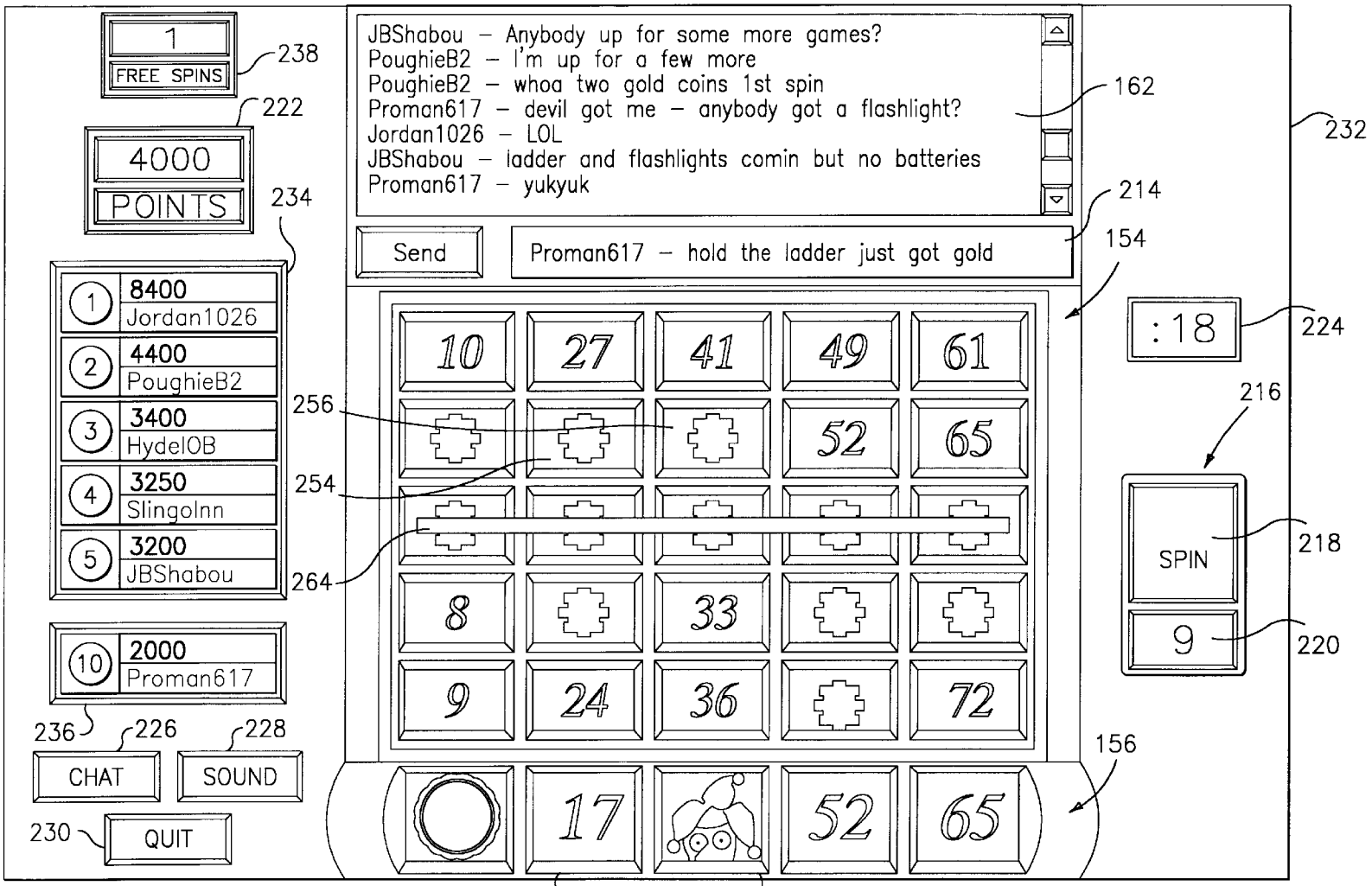
FIG. 11 is an alternative display screen including a small chat room window for playing the bingo-like game.

As shown in FIG. 11, a selection has been made of a bingo number 252 matching a corresponding bingo number in a block in the corresponding column, i.e. the second column of the matrix 154. The disclosed computer system and method then automatically covers, i.e. modifies the appearance of, the matching number to appear as a covered display region 254.

That is, in response to user inputs through the input device 136 and the GUI 142 corresponding to the selection of a selected symbol 252 graphically displayed in the selectable display regions 156, the selection means 146 of the processor 132 causes the GUI 142 to generate and display a cover icon, such as the graphic shown in the covered display region 254. Alternatively, the covering of a matching number may be depicted by changing the appearance of the matching number yet still displaying the number; for example, the matching number may be a first color as a foreground, while the background may be changed from, for example, white or gray in an uncovered state, and red in a covered state.

The selection means 146 then instructs the GUI 142 to change the display region 254 to be covered to display a covered display region. The selection means 146 may be embodied as a software routine using GUI and "WINDOWS" graphical processing known in the art.

The disclosed computer system and method also processes a user selection of the unused joker icon 244 in FIG. 10 to generate a covering icon in a selected block 256 of the corresponding column, regardless of whatever number is displayed in a selected block of the matrix 154. In response to a user selection of one of the blocks 256 in a corresponding column to be covered using a joker, the disclosed computer system then changes the unused joker icon 244 such as shown in FIG. 10 to a used joker icon 260 as shown in FIG. 11, to indicate that the joker feature has been used. During some turns, more than one joker symbol may be generated and displayed in the selectable display regions 156, so different joker icons 244, 260 are used to indicate unused and used jokers, respectively.

In an alternative embodiment, the user may also undo any covering of blocks in the matrix 154; i.e. the user may alter the currently displayed symbols in the matrix 154 before the end of the turn; i.e. within the thirty second time limit. Such flexibility in bingo number and joker processing provides for strategic trade-offs as well as enhanced and more enjoyable play.

After placement of all selectable icons, as shown in FIG. 11, bingo determining means 148 of the processor 132 evaluates the symbols displayed in the matrix to determine any valid bingo conditions and any points awarded therefrom to be displayed in points indicator 222 and added to the current score of the viewing user, using the score generator 150, displayed in the score windows 234–236. For example, the third row depicts a bingo condition; i.e. all block covered, so, for example, 100 points are awarded for the combination of covered blocks in the third row of the matrix 154.

Alternatively, the bingo determining means 148 may determine a valid bingo condition and generate a bingo indication signal to graphically and/or audibly indicate such a condition. For example, a continuous bar 264 may be displayed overlapping the covered blocks corresponding to the valid bingo condition, as shown in FIG. 11. Alternatively, the display regions for the covered blocks corresponding to the valid bingo combination may flash, blink, or otherwise change appearance either temporarily or permanently during a single game turn or during the remaining game session.

The audible indication of the valid combination may be a predetermined tingling sound generated by the processor 132, for example, using a sound card and WAV files, as described above. Such audible indications may be de-activated by toggling the SOUND icon 228.

Activation of the CHAT icon 226 during play, with the active game screen 232 being displayed, causes the chat room window 162 to be displayed with a text entry region 214, as shown in FIG. 11, for example, with smaller dimensions than in the introductory game screen 210 in FIG. 9. Subsequent activation of the CHAT icon 226 toggles the chat room window 162 to close, with the CHAT icon 226 modified to have the indicia OPEN CHAT, as shown in FIG. 10, to open the chat room window 162 upon activation, as shown in FIG. 11.

In operation, in a preferred embodiment, the disclosed computer system may be initialized for operating the bingo-like game in a standard bingo mode; i.e. the selectable symbol generator 144 is set to generate only a standard bingo set of numbers ranging from 1 to 75, and to not generate the special symbols such as the joker, the devil, the gold coin, or the free spin icon, as described above.

The disclosed computer system generates a filled matrix 154; i.e. all twenty-five display regions of five rows and five columns are displayed with randomly generated numbers using a first random number generator, with the numbers in each column of the matrix 154 being limited by a respective range; i.e. 1–15, 16–30, 31–45, 46–60, and 61–75, respectively. The selectable symbol generator 144 then generates one set of five numbers for each of five turns, with each set of five numbers being randomly generated to simulate a bingo drawing of random numbers. In the preferred embodiment, repetitions of bingo numbers does not occur. During each of the five turns, each set of five numbers is displayed in the selectable display regions 156, and, during the turn, the user places each number matching a number in the matrix 154 by clicking on the corresponding number in the selectable display regions 156. The disclosed computer system then automatically covers the corresponding number in the matrix 154.

The goal of selecting bingo numbers and jokers is to selectively cover the numbers in the matrix 154 to form as many valid bingo combinations as possible, and preferably higher scoring bingo combinations, such as simultaneously forming two or three bingo combinations in one turn, in order to increase the final score at the end of the five turn session.

After selection of a matching bingo number by a user, the corresponding selected number in the selectable display regions 156 is blocked out, or alternatively, the appearance of the selected bingo number or symbol in the selectable display regions 156 is modified to indicate that such number has been selected and may not be selected again.

The end of a given turn may be indicated by placement of the fifth number of a given set during the given turn in the matrix 154, which causes the disclosed computer system to automatically go to the next turn to generate the next set of five selectable symbols, or, after the fifth turn, to the end of the five-turn game session as described below. Alternatively, the end of a turn may be indicated by the user actuating the SPIN icon 218.

At the end of each turn, the disclosed computer system, using the bingo determining means 148 in conjunction with the valid combinations 166 stored in the memory 138, determines if any valid bingo condition have been generated during the turn. If so, the score generator 150 in conjunction with the point table 168 stored in the memory 138 generates the current points awarded for the turn and updates the score of the user displayed in the score windows 234–236.

After the five turns of placing each of the five sets of five numbers in the matrix 154, the entire matrix 154 of twenty-five display regions may be filled, and the final score of the user is generated and displayed. In the preferred embodiment, the user obtains credit; i.e. points, for the most bingo combinations.

During each turn, disclosed computer system displayed the current score for the turn of the user viewing the active game screen 232 in the points indicator 222, as shown in FIGS. 10–11. The disclosed computer system also displays the total score of the viewing user in conjunction with the scores of other users in a multi-player game session using the score windows 234–236, so that the viewing user may see how the viewing user stands compared to the other users, which enhances the play and the enjoyment of the game.

Accordingly, in the preferred embodiment, the disclosed computer system and method allow a user to play five turns of standard bingo; i.e. using only the numbers corresponding to the standard set of bingo numbers ranging from 1–75. In the preferred embodiment, the special symbols and features such as the joker, the devil, the gold coin, and the free spin are disabled.

Figure 15:
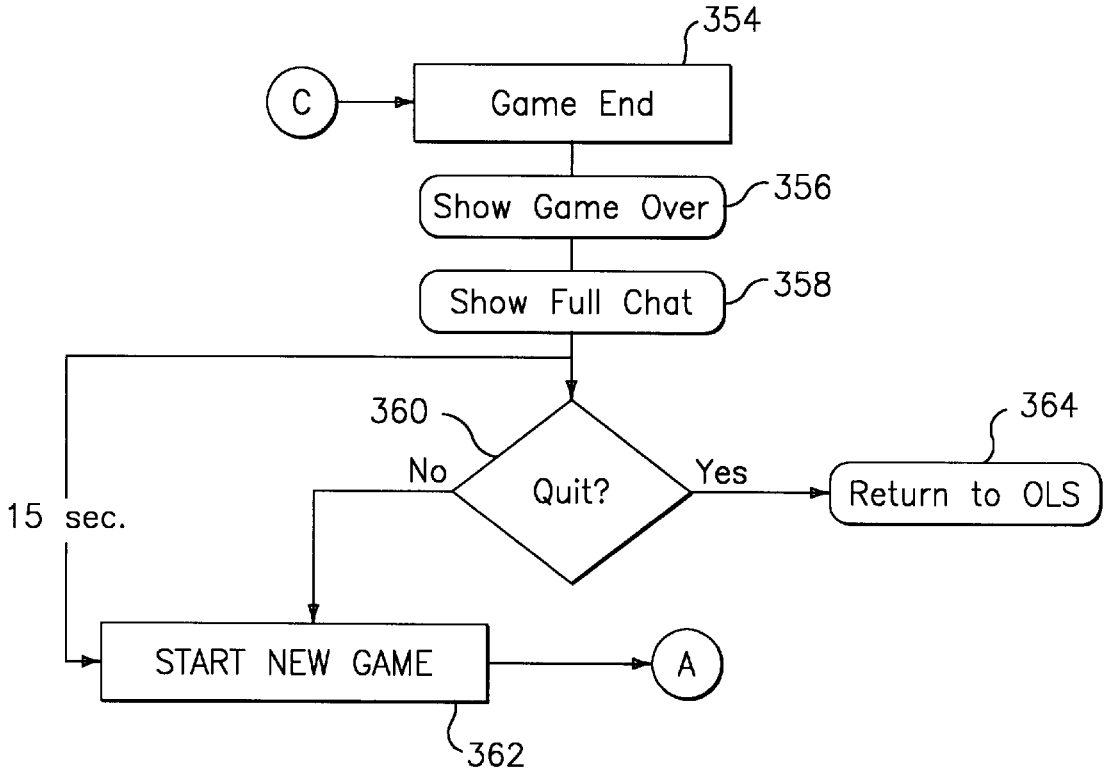
FIGS. 13–15 are flowcharts of the disclosed method for implementing the computer-based bingo-like game.
Figure 13:
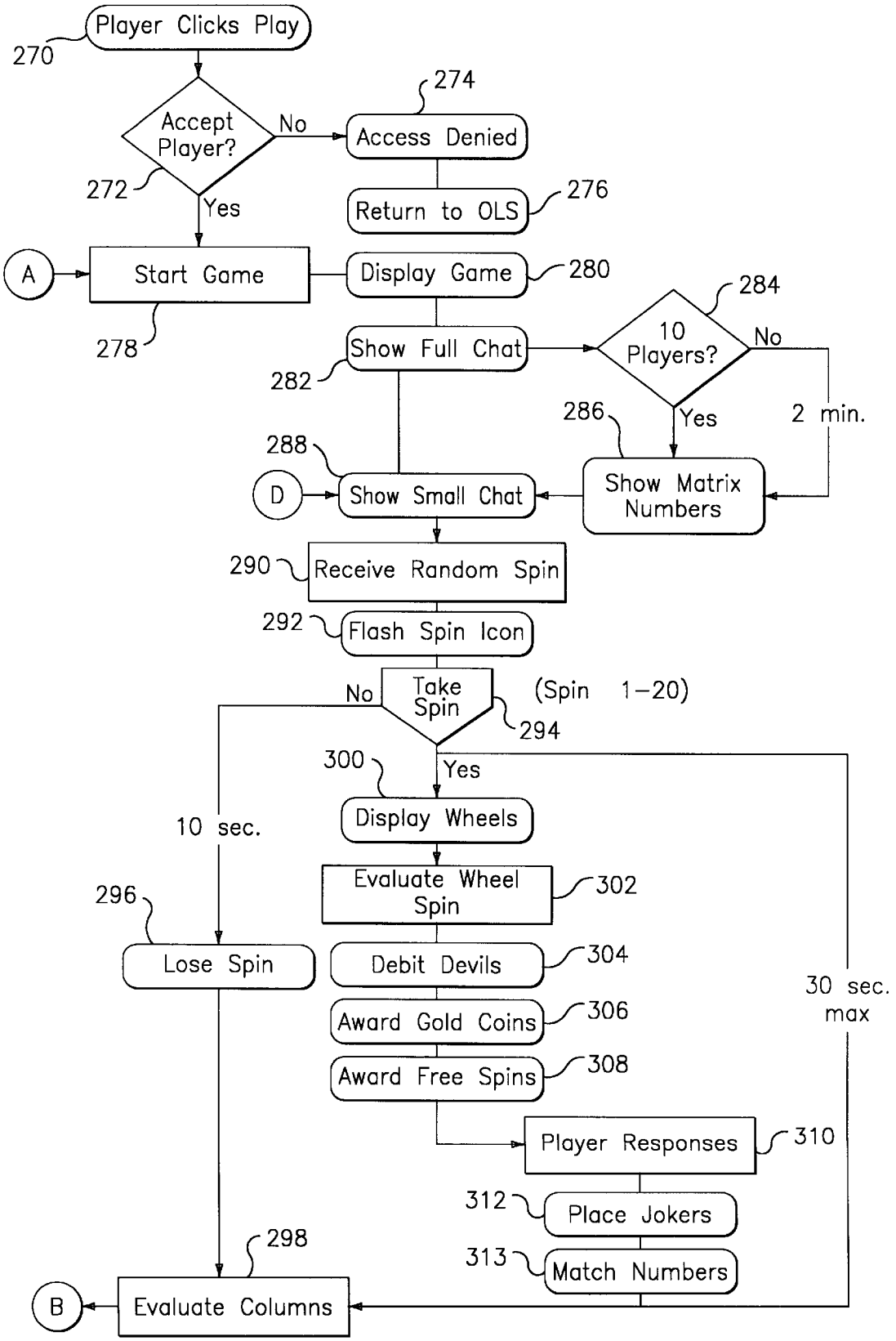
Figure 14:
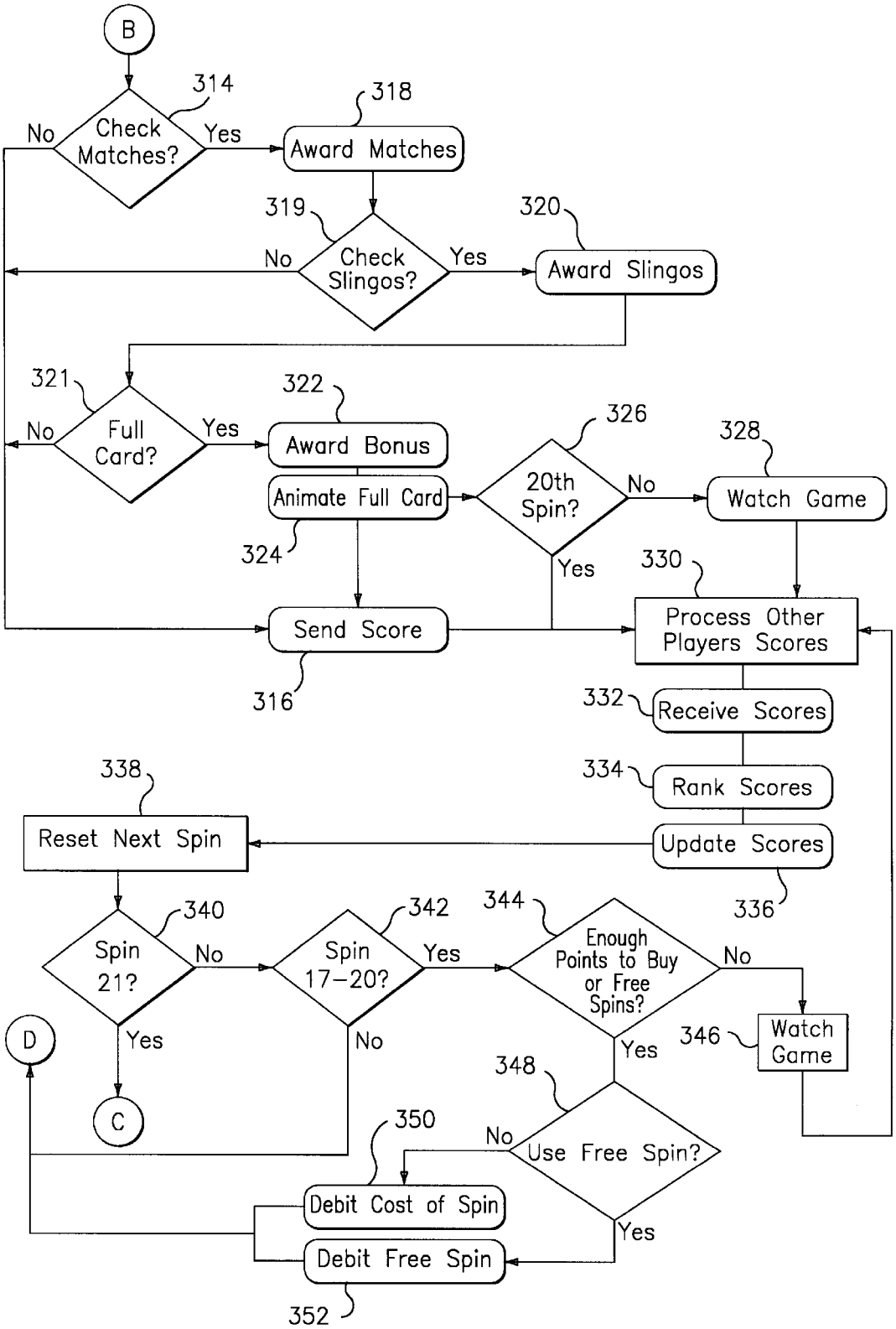

In an alternative embodiment, in operation, the disclosed computer-based system operates according to the method shown in FIGS. 13–15 to implement the bingo-like game described above and having the special symbols and features such as the joker, the devil, the gold coin, and the free spin enabled.

Hereinafter, the method of the disclosed computer-based system in this alternative embodiment is described with reference to operation of the multi-player configuration using the components shown in FIGS. 6–8. It is to be understood that the disclosed computer-based system for playing the bingo-like game may be operated for a single user and/or with a stand-alone computer such as a personal computer and as described above with reference to FIG. 5. Accordingly, the method shown in FIGS. 13–15 may be adapted for operation with a single user; for example, by disabling and/or removing the various steps directed to multi-player operation.

Initially, the user activates a computer to be used in the disclosed computer-based system, which displays a pre-game screen (not shown) generated by an OLS, which includes an activation icon, such as an icon labelled PLAY, to initiate the game. After the player clicks PLAY in step 270, the method decides in step 272 whether to accept the player; for example, players may require to enter a password and/or to use an encrypted token for verification of membership to a subscription service and/or may have to pay to play. Other access procedures may include parental controls to prevent minors from using the bingo-like game, since the awarding points and the multi-player competition may be perceived as gambling.

If access is denied in step 274, the player is returned to the OLS. Otherwise, the method starts the game in step 278 and displays the introductory game screen 210 in step 280 shown in FIG. 9. The method also shows the full chat room window 162 in step 282, and waits in step 284 either for ten players to enter the "waiting room" queue or for two minutes to pass before starting the game session with the queued players.

Hereinafter, the described method refers to a single player using the disclosed computer-based system and method operating in a multi-player mode to conduct a multi-player game; however, it is understood that, in the multi-player game, the method performs the steps with respect to each player and operates multiple game sessions concurrently, with each game session performed independently for each player.

The method then generates and displays a filled matrix 154 in step 286 to shown twenty-five uncovered matrix numbers. During play, such matrix numbers are covered, as shown in FIG. 10, as described above. Alternatively, a predetermined number of such matrix numbers may be pre-covered. The method may, by default, display in step 288 the small chat room window as shown in FIG. 11. The method then optionally performs a first spin for the first turn only; i.e. generates in step 290 a set of five random symbols using the selectable symbol generator 144 for illustrative purposes only to the player, as the selectable display regions 156 are initially blank. Accordingly, the method may optionally simulate an actual slot machine which typically always displays a set of wheels or symbols, including at the beginning of the game.

The method then flashes the spin icon 218 in step 292; i.e. changes the appearance and/or color of the spin icon 218 and/or displays new text such as NEXT TURN or SPIN NOW. The player then has ten seconds to take a spin in step 294. If the player does not activate the spin icon 218, the player loses the spin and thus the turn in step 296, and the current matrix 154 is evaluate in step 298, as described below.

If the player takes a spin in step 294, the selectable symbol generator 144 generates a current set of five symbols for display in step 300 in the selectable display regions 156, simulating slot machine wheels. In a preferred embodiment, each player in the multi-player configuration receives a unique set of five randomly generated symbols in step 300. In an alternative embodiment, every player in the multi-player configuration receives an identical set of five randomly generated symbols.

The method then evaluates the current wheel spin in step 302 to determine whether any devils, gold coins, free spins, or jokers have been displayed. The method then proceeds to debit devils in step 304, which may include clearing to zero or, alternatively, halving the entire score of the player; i.e. the score generator 150 modifies the score appropriately in response to the generation of a devil symbol 248.

The method then awards the player for any gold coins in step 306; i.e. a predetermined amount of points, such as 1000 points, are added to the current point total displayed in the point indicator 222. The method also awards any free spins to the player in step 308 by incrementing the free spin indicator 238. The method then processes player responses in step 310; i.e. inputs through the GUI 142 to select any bingo symbols for covering corresponding bingo numbers in the matrix 154, such as illustrated in FIG. 11.

The method then processes user inputs to place jokers in step 312 to cover any numbers in a column corresponding to the column in which the joker is displayed in the selectable display regions 156. The method then determines in step 313 if the player is attempting to cover a number in the matrix 154 which matches or does not match a number in the selectable display regions 156. If a player tries to cover a number in the matrix 154 which does not match a number in the selectable display regions 156, the method does not respond and/or generates a beep or other sounds to indicate no match. Alternatively, the method may generate a screen message to the player indicating no match.

The player has a preset maximum time to respond to the spin generated in step 300 to perform steps 300–313. For example, steps 300–313 are to be performed within thirty seconds. Since the method is computer-based, step 300–308 are typically performed in less than about two seconds, so the majority of the response time is borne by the player in steps 310–313. If the time limit is not met, as shown in the time indicator 224 which counts down to zero, the player is prevented from processing any unprocessed symbols or jokers, and the method proceeds to step 298. The maximum response time of about thirty seconds presents a challenge to the player to process the symbols and jokers rapidly, which enhances play of the bingo-like game.

In performing step 298, the method evaluates all symbols displayed in the matrix 154 using the bingo determining means 148 and the score generator 150. The method proceeds to step 314 to check for any matches made by the user to cover matching numbers. If there were no matches, the method proceeds to step 316. Otherwise, any matches may be awarded a predetermined number of points, such as 100 points, in step 318.

The method then checks for the occurrence of any bingo conditions in step 319, which is referred to herein as a "slingo"; i.e. a bingo condition including a complete set of five contiguous covered numbers in the matrix 154 formed in a row, in a column, or in the main diagonals of the matrix 154. The determination of bingo conditions in step 319 is performed by the method using the bingo determining means 148 and the database of valid combinations 166 as described above.

If there are no new valid combinations detected in step 319, the method proceeds to step 316 to update the score of the current player using the score generator 150 and to send the score in step 316 for display to all players.

If there are valid combinations detected in step 319, the method generates corresponding points for each valid combination using the point table 168 in step 320 to award any slingos, and also updates the point indicator 222.

The method then determines if the entire matrix 154 is filled with covered symbols in step 321; i.e. corresponding to a full bingo card. If not, the method ends the turn and sends the current points for the turn to the score generator 150 to generate and send the current score to all players in step 316. Otherwise, for a full card detected in step 321, a bonus of, for example, 2000 points is awarded in step 322 and the point indicator 222 is incremented accordingly. The method then animates the matrix 154 in step 324; i.e. the appearance and/or colors of the matrix are changed to flash.

The method then ends the turn and the updated total points for the turn is sent to the score generator 150 in step 316. The method also detects whether the last turn ended in step 326 was the $20^{TH}$ turn of the player. If not, the player must wait and watch the game in step 328 until all other players are finished with their current turn and the method proceeds to step 330. Otherwise, if the player has finished the $20^{TH}$, the player is finished with the game session after step 326, and the method then proceeds to step 330, in which the scores of all other players are processed.

The user terminal 172 of a current user then receives the scores of the other players in step 332, ranks such scores in step 334, and updates the scores in step 336 to display such ranked scores in the score windows 234–236.

The method then resets the user terminals 172 for all players in step 338 by incrementing by one a spin count stored the memory 138 to be displayed in the spin or turn indicator 220. If the incremented spin count equals 21 as determined in step 340, the incremented spin count is not displayed by the turn indicator 220, and the method proceeds to end the game in step 354. Otherwise, the method determines whether the spin count is within the range of 17–20 in step 342.

If not, then the spin count is less than 17, and so the method proceeds to step 288 to repeat steps 288–342 for additional turns. Otherwise, if the spin count is within the range of 17–20, the method determines whether each player has any free spins and/or enough points in the total score of the player to "buy" additional spins in step 344. The fee schedule for additional spins may be, for example, 500 points for spin 17, 1000 points for spin 18, 1500 points for spin 19, and 2000 points for spin 20. Such a fee schedule may be displayed to the user, and the user may also be queried whether to purchase such additional spins.

If the player cannot buy additional spins and does not have any free spins, the game session of the player ends, and the player is relegated to watching the game in step 346; i.e. the scores of the other players are updated for spins 17–20 and displayed to the relegated player.

If the player has free spins or enough points to buy additional spins, the method queries the player in step 348 whether or not to use a free spin, using the query window 240 shown in FIG. 12. If the player chooses not to use a free spin, the cost of the spin is debited in step 350 from the score of the player displayed in the score windows 234–236. Otherwise, the choice of the player to use a free spin causes the number of free spins to be debited from the free spin indicator 238 in step 352.

It may be advantageous to not use free spins and to purchase additional spins in turns 17–19 in order to save any free spins which a user may have, as indicated by the free spin indicator 238, in order to avoid purchasing the higher costing spins in turns 18–20, and to thus maximize the score by reducing the amount debited. After steps 350–352, the method proceeds to step 288 to repeat steps 288–340 for turns 17–20.

After turn 20 is attained by all players, which is detected in step 340, the method proceeds to end the game session in step 354, by displaying a GAME OVER message in step 356, and generating the full chat room window 162 as shown in FIG. 9 in step 358. In an alternative embodiment, after step 356, the method may display a list of highest scores recorded for different time frames, such as within the last month or within the last year.

The method then queries each player whether to quit playing the bingo-like game in step 360. If a player chooses not to quit in step 360 or does not respond for a predetermined response time, such as 15 seconds, the method starts a new game in step 362 and proceeds to step 278.

Otherwise, upon a player choosing to quit the bingo-like game, the method returns the player to the OLS in step 364.

It is to be understood that the option to quit may always be provided to the player, concurrently with the game session and during any turn, through the display of the actuatable QUIT icon 230, or alternatively through implementation of other icons on a taskbar or of a predetermined set of keys or hotkeys using a keyboard and/or a mouse which end the game session upon actuation.

In addition, as described above, the chat room features may be toggled and used concurrently with the game session and during any turn. For example, during steps 294–312, if a player has completed processing symbols before the thirty second time limit, the player may engage in entering and send and/or reading text in the chat room window 162.

While the disclosed computer-based system and method have been particularly shown and described with reference to the preferred embodiments, it is understood by those skilled in the art that various modifications in form and detail may be made therein without departing from the scope and spirit of the invention.

As will become readily apparent to those skilled in the art, the matrix 154 may be a series of television screens for displaying symbols within each block, a single screen subdivided into blocks for displaying symbols, individual display screens per block, or other display systems as would be found on slot machines, video games, computer systems, and the like.

The disclosed computer-based system may also be configured with input devices simulating a slot machine activating arm and coin slot as would be typically found in a slot machine for playing bingo in the prior art. Further, the input devices may be trackballs or other pointing and GUI devices, and the selectable display regions may include LED or LCD displays, which may be fixed in a housing or mounted on the spinning wheels of a slot machine.

In addition, the multi-player networked configuration may involve distributed communication systems in hybrid forms for interactive TV and cable implementations. Further, the game screens 210 and 232 may be adapted for displaying advertisements, including animated advertisements, as well as other information, such as TV and cable broadcasts.

Accordingly, modifications such as those suggested above, but not limited thereto, are to be considered within the scope of the invention.

What is claimed is:

1. A device for playing a bingo-style game comprising:

an input device for receiving user inputs;

a display for displaying a graphic user interface (GUI) including:

a five column by five row random number display matrix;

five display regions, each display region corresponding to each column of the display matrix; and a plurality of user-actuatable icons, including an actuation icon; and a processor, responsive to the user inputs, for executing an application program to cause the display of the GUI, the processor including a first random number generator for generating five sets of random numbers for display by the five column by five row random number display matrix, wherein the five sets of random numbers are generated such that:

the first set includes random numbers ranging from 1 to 15;

the second set includes random numbers ranging from 16 to 30;

the third set includes random numbers ranging from 31 to 45;

the four set includes random numbers ranging from 46 to 60;

the fifth set includes random numbers ranging from 61 to 75; and each set of random numbers is generated without repetition within the respective set;

wherein the processor includes:

a second random number generator, responsive to the user inputs corresponding to actuation of the actuation icon by the user, for generating a sixth set of random numbers for display by the five display regions;

comparing means for comparing the sixth set of random numbers displayed in the five display regions with the numbers in the corresponding columns of the display matrix, and, if they match, allowing the processor to respond to user inputs corresponding to selected matching numbers, to automatically cover the matching number in the display matrix; and determining means for determining whether the display matrix has five numbers covered in a row, five numbers covered in a column, five numbers covered in a diagonal, or all of the numbers are covered, and for generating a bingo indication signal for indicating a bingo condition.

2. The device according to claim 1 wherein the first and second random number generators, the comparing means, and the determining means are implemented in software and operated on a computer system.

3. The device according to claim 1 wherein the processor is implemented as a video game.

4. The device according to claim 1 wherein the display displays uncovered random numbers with a white background, and displays covered random numbers with a predetermined display image.

5. A system for playing a bingo-style game with a plurality of players on a common display matrix of rows and columns defining blocks comprising:

a plurality of input devices for receiving user inputs from the plurality of players;

a processor executing an application program for implementing:

a first random number generator for generating sets of random numbers to be displayed in each block of the common display matrix, the sets of random numbers are generated such that each set of random numbers has a distinct range from the other sets of random numbers, and each set of random numbers is generated without repetition within the respective set;

a second random number generator for generating and displaying a plurality of sets of numbers for each of the plurality of players, the size of the number set equal and corresponding to the number of columns within the display matrix;

a graphic user interface (GUI) for displaying the display matrix, the sets of random numbers generated by the first random number generator, the plurality of sets of numbers generated by the second random number generator, and a plurality of activation icons for activating the second random number generator for generating a set of numbers for a corresponding one of the plurality of players, wherein the plurality of activation icons respond to corresponding user inputs from the plurality of players, respectively; and comparing means for comparing the random numbers generated by the second random number generator with the random numbers displayed in the corresponding column of blocks of the display matrix and for causing the display matrix to cover any block within the corresponding column having a number matching the corresponding number generated by the second random number generator.

6. The system accordingly to claim 5 wherein:

the processor includes a first computer; and the plurality of input devices include a plurality of computing devices remotely disposed relative to the processor, each computing device including a respective display for displaying the common display matrix.

7. The system according to claim 6 wherein the processor is connected to the plurality of input devices through the Internet; and the plurality of input devices includes a plurality of computing devices adapted for Internet-compatible operation.

8. The system according to claim 7 wherein the processor includes software, responsive to text inputs from the plurality of input devices, for generating a common chat room display of the text inputs; and the plurality of input devices displays the common chat room display for displaying the text inputs.

* * * * *

UNITED STATES PATENT AND TRADEMARK OFFICE

CERTIFICATE OF CORRECTION

PATENT NO. : 5,935,002

DATED : August 10, 1998

INVENTOR(S) : Sal Falciglia

It is certified that error appears in the above-identified patent and that said Letters Patent is hereby corrected as shown below:

On the title page, insert item [73] Assignee: Slingo, Inc.
Ridgewood, NJ

Signed and Sealed this

Ninth Day of May, 2000

*Attest:*

Q. TODD DICKINSON

*Attesting Officer*

*Director of Patents and Trademarks*